US006303565B1

(12) United States Patent
Clarke et al.

(10) Patent No.: US 6,303,565 B1
(45) Date of Patent: Oct. 16, 2001

(54) METHOD OF STABILIZING FABRIC SOFTENING COMPOSITIONS

(75) Inventors: David Ellis Clarke; Samantha Small, both of Wirral (GB)

(73) Assignee: Unilever Home & Personal Care USA, Divison of Conopco, Inc., Greenwich, CT (US)

( * ) Notice: Subject to any disclaimer, the term of this patent is extended or adjusted under 35 U.S.C. 154(b) by 0 days.

(21) Appl. No.: 09/569,663

(22) Filed: May 12, 2000

(30) Foreign Application Priority Data

May 21, 1999 (GB) ..... 9911942
Jun. 18, 1999 (GB) ..... 9914266

(51) Int. Cl.[7] ..... C11D 1/835
(52) U.S. Cl. ..... 510/527
(58) Field of Search ..... 510/527

(56) References Cited

U.S. PATENT DOCUMENTS 4,406,688 * 9/1983 Konno et al. ..... 71/92
5,540,853 * 7/1996 Trinh et al. ..... 510/101
6,013,682 * 1/2000 Dalle et al. ..... 516/55
6,114,299 * 9/2000 Hunter et al. ..... 510/466

FOREIGN PATENT DOCUMENTS

3608093 * 9/1987 (DE) .
0 285 391 10/1988 (EP) .
0 356 210 2/1990 (EP) .
0 544 493 6/1993 (EP) .
0 661 398 7/1995 (EP) .
0 789 070 8/1997 (EP) .
91/19037 12/1991 (WO) .
95/11746 5/1995 (WO) .
97/31998 9/1997 (WO) .

OTHER PUBLICATIONS

International Search Report dated May 8, 2000.

* cited by examiner

*Primary Examiner*—John Hardee

(57) ABSTRACT

The invention provides a process of improving the viscosity stability upon storage at temperatures of 25° C. or more but below 40° C. of a fabric softening composition comprising:

(a) a 8 to 50% by weight of a cationic fabric softening agent; and (b) perfume by the inclusion of 3.5% to 15% by weight of an emulsified silicone, based upon the total amount of the composition, which has been emulsified with one or more cationic surfactants. In one aspect, the viscosity of the silicone before emulsification is from 10,000 cSt to 400,000 cSt, preferably from 20,000 cSt to 350,000 cSt, more preferably from 25,000 cSt to 250,000 cSt and the emulsion is a macro-emulsion. In another aspect, the median emulsified silicone droplet size is at least 0.2 $\mu$m, preferably at least 0.25 $\mu$m, more preferably at least 0.39 $\mu$m, preferably also no greater than 25 $\mu$m.

13 Claims, No Drawings

METHOD OF STABILIZING FABRIC SOFTENING COMPOSITIONS

TECHNICAL FIELD

The present invention relates to a method of stabilising the viscosity of fabric softening compositions comprising cationic fabric softening agents and perfume.

BACKGROUND AND PRIOR ART

Fabric softener compositions, especially those added in the rinse, are well known. Typically, these compositions comprise a cationic fabric softening agent and perfume. However, frequently these compositions suffer from problems with viscosity stability during storage, especially at storage at, or above, room temperature. The compositions may also suffer with physical stability during storage. Often this is associated with viscosity stability problem.

This has been found to be particularly problematic in fabric softener compositions comprising relatively high levels of fabric softeners actives, e.g. 8% by weight and above, and, of perfume.

It is known to incorporate one or more additional materials, such as silicones, to reduce wrinkling of the fabric during the rinsing and drying stages of the wash.

For example WO-A-96/15309 discloses the use of a combination of a silicone and a film-forming polymer for this purpose. (C) PCT Typical silicones in this application are polydiorganosiloxanes. In many prior art compositions, the silicones are incorporated in the form of an emulsion, which is a micro-emulsion, that is to say the silicone is present as liquid droplets having a droplet size less than the wavelength of visible light and so the emulsion is substantially transparent. However, in a few cases, they are macro-emulsions (e.g. WO-A-97/31997 and WO-A-97/31998). The silicones before emulsification are those having relatively low viscosities, because it is assumed that those with higher viscosities are more difficult to handle during the process of manufacturing the product and are less suited for anti-creasing performance. WO-A-95/24460 discloses a fabric softening composition which contains from about 0.2% to about 20% of a polydimethyl siloxane having a viscosity from about 2 to 5,000 centi-Stokes (cSt).

Our co-pending British patent application 9911942.2 describes fabric softening compositions comprising a cationic fabric softener and an emulsified silicone which has a viscosity before emulsification of 10,000 cSt to 1,000,000 cSt and is a macro-emulsion, and/or, has a median droplet size in the emulsion of at least 0.2 $\mu$m and is emulsified with an emulsifier comprising one or more cationic surfactants.

However, the above do not disclose how to provide improved viscosity stability upon elevated temperature storage for fabric softening compositions comprising cationic fabric softeners and perfume.

The present invention seeks to address the problems with viscosity stability upon storage at temperatures above. room temperature, in particular between 25° C. but below 40° C.

It has now been discovered that surprisingly good viscosity stability upon storage at temperatures above room temperature can be achieved by formulating concentrated fabric softening compositions with 3.5 to 15% by weight of a silicone which is emulsified with one or more cationic surfactants and which is incorporated in the form of a macro-emulsion and which silicone has a viscosity of from 10,000cSt to 400,000cSt, and/or the emulsified silicone has a median droplet size of at least 0.2 $\mu$m.

References herein to the "emulsified silicone emulsion" are to be construed as being to the emulsion product containing the emulsified silicone. References to the "emulsified silicone" are to be construed as being to the emulsified silicone within the emulsion product that is added to the fabric softening composition.

DEFINITION OF THE INVENTION

Thus according to a first aspect of the invention there is provided a method of improving the viscosity stability upon storage at temperatures of 25° C. or more but below 40° C. of a fabric softening composition comprising:

(a) 8 to 50% by weight of a cationic fabric softening agent; and (b) perfume;

by the inclusion of 3.5% to 15% by weight of an emulsified silicone, based upon the total amount of the composition, which has been emulsified with one or more cationic surfactants to form a macro-emulsion, with the viscosity of the silicone before emulsification being from 10,000 cSt to 400,000 cSt, preferably from 20,000 cSt to 350,000 cSt, more preferably from 25,000 cSt to 250,000 cSt.

A second aspect of the present invention provides a method of improving the viscosity stability upon storage at temperatures between 25° C. or more but below 40° C. of a fabric softening composition comprising:

(a) 8 to 50% by weight of a cationic fabric softening agent; and (b) perfume;

by the inclusion of 3.5% to 15% by weight of an emulsified silicone, based upon the total amount of the composition, wherein the median droplet size of the emulsified silicone is at least 0.2 $\mu$m, preferably at least 0.25 $\mu$m, more preferably at least 0.39 $\mu$m, preferably also no greater than 25 $\mu$m and the silicone is emulsified with an emulsifier comprising one or more cationic surfactants.

A third aspect of the present invention provides a fabric softening composition comprising;

(a) 8 to 50% by weight of a cationic fabric softening agent; and (b) perfume; and (c) 3.5% to 15% by weight of an emulsified silicone has been emulsified with one or more cationic surfactants to form a macro-emulsion;

wherein the viscosity of the silicone before emulsification is from 10,000 cSt to 400,000 cSt, preferably from 20,000 cSt to 350,000 cSt, more preferably from 25,000 cSt to 250,000 cSt.

A fourth aspect of the present invention provides a fabric softening composition (a) 8 to 50% by weight of a cationic fabric softening agent; and (b) perfume;

(c) 3.5% to 15% by weight of an emulsified silicone which has been emulsified with one or more cationic surfactants;

wherein the median droplet size of the emulsified silicone is at least 0.2 $\mu$m, preferably at least 0.25 $\mu$m, more preferably at least 0.39 $\mu$m, preferably also no greater than 25 $\mu$m.

The methods according to the present invention may optionally embody both the first and second aspects of the present invention and compositions of the present invention optionally may embody both the third and fourth aspects.

For the avoidance of doubt, in the context of the present invention, the term emulsified silicone means that the silicone is in emulsion form prior to incorporation in the fabric softening composition but does not necessarily remain in that form in the final product.

The cationic fabric softening agent may comprise one or more cationic fabric softening materials and the emulsified silicone may comprise one or more individual silicone materials.

DETAILED DESCRIPTION OF THE INVENTION

Method

The method of the present invention provides a fabric softening composition having improved viscosity stability upon storage at elevated temperatures, e.g. 25° C. and above, particularly 25° C. and above but below 40° C., e.g. at 37° C., by the addition of 3.5% to 15% by weight of the emulsified silicone described below.

The emulsified silicone may be included in the fabric softening composition at any suitable time during its preparation. The emulsified silicone may be post-added to a fabric softening composition comprising a cationic fabric softening agent and a perfume, e.g. where the composition has been formed as in the following examples. Alternatively, the emulsified silicone may be added to the cationic fabric softening agent and then the perfume added thereto, or, the perfume and softening agent may be added to the emulsified silicone.

The method preferably provides a fabric softening composition comprising a cationic fabric softening agent and perfume (as referred to herein) having viscosity stability upon storage at 37° C. for 43 days or more, preferably 56 days or more. For example, the viscosity does not increase or decrease by a factor of 3, preferably not by more than a factor of 2.5, e.g. not more than a factor of 2 of the initial viscosity, during storage.

Cationic Fabric Softening Agents

Preferably, the cationic fabric softening agent is a quaternary ammonium material or a quaternary ammonium material containing at least one ester group. The quaternary ammonium compounds containing at least one ester group are referred to herein as ester-linked quaternary ammonium compounds. Both non-ester linked quaternary ammonium compounds and ester-linked quaternary ammonium compounds may be used according to the invention.

As used herein the term ester group, when used as a group in the quaternary ammonium material, includes an ester group which is a linking group in the molecule.

It is preferred for the ester-linked quaternary ammonium compounds to contain two or more ester groups. In both monoester and the diester quaternary ammonium compounds it is preferred if the ester group(s) is a linking group between the nitrogen atom and an alkyl group. The ester groups(s) are preferably attached to the nitrogen atom via another hydrocarbyl group.

Also preferred are quaternary ammonium compounds containing at least one ester group, preferably two, wherein at least one higher molecular weight group containing at least one ester group and two or three lower molecular weight groups are linked to a common nitrogen atom to produce a cation and wherein the electrically balancing anion is a halide, acetate or lower alkosulphate ion, such as chloride or methosulphate. The higher molecular weight substituent on the nitrogen is preferably a higher alkyl group, containing 12 to 28, preferably 12 to 22, e.g. 12 to 20 carbon atoms, such as coco-alkyl, tallowalkyl, hydrogenated tallowalkyl or substituted higher alkyl, and the lower molecular weight substituents are preferably lower alkyl of 1 to 4 carbon atoms, such as methyl or ethyl, or substituted lower alkyl. One or more of the said lower molecular weight substituents may include an aryl moiety or may be replaced by an aryl, such as benzyl, phenyl or other suitable substituents.

Preferably the quaternary ammonium material is a compound having two $C_{12}$–$C_{22}$ alkyl or alkenyl groups connected to a quaternary ammonium head group via at least one ester link, preferably two ester links or a compound comprising a single long chain with an average chain length equal to or greater than $C_{20}$.

More preferably, the quaternary ammonium material comprises a compound having two long chain alkyl or alkenyl chains with an average chain length equal to or greater than $C_{14}$. Even more preferably each chain has an average chain length equal to or greater than $C_{16}$. Most preferably at least 50% of each long chain alkyl or alkenyl group has a chain length of $C_{18}$. It is preferred if the long chain alkyl or alkenyl groups are predominantly linear.

The most preferred type of ester-linked quaternary ammonium material that can be used in compositions according to the invention is represented by the formula (A):

(A)

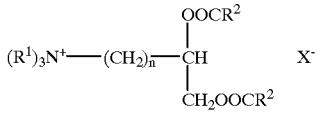

wherein $R^1$, n, $R^2$ and $X^-$ are as defined below.

Preferred materials of this class such as 1,2 bis [hardened tallowoyloxy]-3-trimethylammonium propane chloride and their method of preparation are, for example, described in U.S. Pat. No. 4, 137,180. Preferably these materials comprise small amounts of the corresponding monoester as described in U.S. Pat. No. 4,137,180 for example 1-hardened tallow-oyloxy-2-hydroxy-3-trimethylammonium propane chloride.

Another class of preferred ester-linked quaternary ammonium materials for use in compositions according to the invention can be represented by the formula (B):

(B)

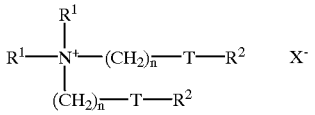

wherein each $R^1$ group is independently selected from $C_{1-4}$ alkyl, hydroxyalkyl or $C_{2-4}$ alkenyl groups; and wherein each $R^2$ group is independently selected from $C_{8-28}$ alkyl or alkenyl groups; $X^-$ is any suitable counter-ion, i.e. a halide, acetate or lower alkosulphate ion, such as chloride or methosulphate.

T is 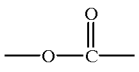 or 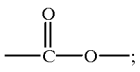 ; and

-continued n is an integer from 1–5 or is 0

It is especially preferred that each $R^1$ group is methyl and each n is 2.

Of the compounds of formula (B), Di-(tallowyloxyethyl)-dimethyl ammonium chloride, available from Hoechst, is the most preferred. Di-(hardened tallowyloxyethyl)dimethyl ammonium chloride, ex Hoechst and di-(tallowyloxyethyl)-methyl hydroxyethyl methosulphate are also preferred.

Another preferred class of quaternary ammonium cationic fabric softening agent is defined by formula (C):

(C)

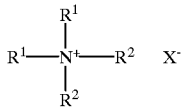

where $R^1$, $R^2$ and $X^-$ are as hereinbefore defined.

A preferred material of formula (C) is di-hardened tallow-dimethyl ammonium chloride, sold under the Trademark Arquad 2HT.

It is advantageous for environmental reasons if the quaternary ammonium material is biologically degradable.

The optionally ester-linked quaternary ammonium material may contain optional additional components, as known in the art, in particular, low molecular weight solvents, for instance isopropanol and/or ethanol, and co-actives such as nonionic softeners, for example fatty acid or sorbitan esters.

The fabric softening agent is present in the composition in a total amount of 8%–50% by weight based upon the total weight of the composition, preferably 10–35%, more preferably 12–30%, more preferably 12–25% such as 12–20%. In some cases the compositions may comprise 3%–8% fabric softener, if these also suffer from viscosity instability problems upon storage. However these less concentrated compositions are less likely to suffer from this viscosity problem.

Perfume

The perfume is typically present in the fabric softening composition in amounts of 0.25% to 2% by weight, preferably 0.27% to 2%, such as 0.3% to 1.5%. It has been found that, at lower levels of perfume, viscosity instability is not as problematic.

One or more perfumes may be present in the compositions.

The perfume used in the invention may be either lipophobic or lipophilic in nature. By a lipophilic perfume is meant that the perfume has a solubility in water (i.e. it dissolves) of 1 g or less in 100 ml of water at 20° C. Preferably solubility in water is 0.5 g or less, more preferably 0.3 g or less. Such perfumes may be referred to as water-insoluble perfumes.

The perfume may be any conventional perfume used in fabric softening compositions. The perfume will thus preferably be compatible with the types of fabric softening actives typically found in fabric softening compositions, although, not many commercially available perfumes will not be compatible. Also the perfume will generally be polar in nature. Examples include the "Softline and Euroglide perfumes (ex Givaudon-Roure).

Perfumes contain a number of ingredients which may be natural products or extracts such as essential oils, absolutes, resinoids, resins etc. and synthetic perfume components such as hydrocarbons, alcohols, aldehydes, ketones, ethers, acids, esters, acetals, ketals, nitrites, phenols, etc. including saturated and unsaturated compounds, aliphatic, alicyclic, heterocyclic and aromatic compounds. Examples of such perfume components are to be found in Perfume and Flavour Chemicals by Steffen Arctander (Library of Congress catalogue card no. 75-91398).

Any perfume which is compatible with the cationic fabric softening agents may be used in the composition.

More than one perfume may be used in the compositions.

Emulsified Silicone

The emulsified silicone is emulsified with one or more cationic surfactants. The term "emulsified silicone" refers to the active silicone.

According to the first and third aspects of the present invention, in the emulsified silicone, the silicone droplets are incorporated to be in the form of a macro-emulsion, that is to say the droplets have a median size in the wavelength range corresponding to the visible spectrum, or even larger. Typically, the emulsion is an oil-in-water (i.e. silicone-in-water) emulsion. The term median size refers to the number average. The visible spectrum is 0.39 $\mu$m to 0.77 $\mu$m.

In the emulsion, the median size of the silicone droplets is then preferably from 0.39 $\mu$m to 25 $\mu$m. In the second and fourth aspects of the present invention, in the emulsion, the silicone droplets have a median size of at least 0.2 $\mu$m, preferably at least 0.25 $\mu$m. The droplet size may be determined based on measurements of median DV05 using a Malvern X Mastersizer.

The silicone may be of any structure which gives rise to the desired viscosity stabilisation effect in fabric softener compositions comprising cationic fabric softener and perfume. Preferably, it has a linear structure. It is preferably a non-functional silicone, especially one which is non-amino functional. Typical silicones are siloxanes which have units of the general formula $R_aSiO_{(4-a)/2}$ wherein each R is the same or different and is selected from hydrocarbon and hydroxyl groups, a being from 0 to 3 and in the bulk material, a has an average of from 1.85–2.2.

Most preferably, the silicone is a polydi-$C_{1-6}$ alkyl (preferably a polydimethyl) siloxane end-terminated either by tri-$C_{1-6}$ alkylsilyl (e.g. trimethylsilyl) groups or by hydroxy-di-$C_{1-6}$ alkylsilyl (e.g. hydroxy-dimethylsilyl) groups, or by both.

Certainly, in the method and compositions of first and third aspects of the present invention and preferably, in the case of the method and compositions of the second and fourth aspects, the silicone has a viscosity before emulsification (as measured on a Brookfield RV4 viscometer at 25° C. using spindle No.4 at 100 rpm) of from 10,000 cSt to 400,000 cSt, preferably from 20,000 cSt to 350,0000 cSt, more preferably from 25,000 cSt to 250,000 cSt.

In all aspects of the present invention, emulsification is effected using one or more cationic surfactants. Preferably, the cation in the cationic surfactant is selected from alkyl tri-methylammonium methosulphates and their derivatives, in which, at least two of the methyl groups on the nitrogen atom are replaced by (poly)alkoxylated groups. Any suitable counter-ion may be used in the cationic surfactant. Preferred counter-ions for the cationic surfactants include halogens (especially chlorides), methosulphate, ethosulphate, tosylate, phosphate and nitrate. The cationic emulsifiers are also believed to enhance deposition of the silicone during use of the fabric softening composition.

The emulsified silicone (as 100% active silicone) is included in the fabric softener compositions in an amount of 3.5% to 15% by weight of the total composition (including the emulsion product containing the silicone emulsion), preferably 3.75% to 12%, more preferably 4% to 10%, most preferably 4.5% to 10%. However it may be possible to include up to 20% by weight if it can be incorporated into the fabric softening composition without instability occurring therein.

Also, mixtures of one or more cationic surfactants with one or more nonionic surfactants can be used.

Preferably, the total of amount of emulsifying cationic surfactant(s) is from 0.5% to 20%, preferably from 2% to 12%, more preferably from 3% to 10% by weight of the emulsion.

The total amount of silicone in the emulsion will generally be up to 70% by weight of the emulsion.

Preferably, the weight ratio of silicone to total emulsifying cationic surfactant(s) is from 2.3:1 to 120:1, preferably 3:1 to 120:1, for example from 3:1 to 30:1. Typical cationic surfactants used in the emulsions are alkyl trimethylammonium methosulphates and chlorides and alkyl ethoxylalkyl ammonium methosulphates and chlorides. Examples include cetyl trimethyl ammonium chloride and coconut pentaethoxymethyl ammonium methosulphate and derivatives in which at least two of the methyl groups on the nitrogen atom are replaced by (poly)alkoxylated groups.

In the final product, the weight ratio of total fabric softening agent to total silicone is preferably from 2.5:1 to 10:1, preferably from 3:1 to 8.5:1, more preferably from 3:1 to 7:1.

Optional Ingredients

The fabric softening compositions may optionally include one or more nonionic surfactants.

Suitable nonionic surfactants which can be used include the condensation products of $C_8$–$C_{30}$ primary or secondary linear or branched alcohols preferably $C_{10}$–$C_{22}$ alcohols, alkoxylated with 4 or more moles of alkylene oxide, preferably 4–25 moles of alkylene oxide, more preferably between 10 and 25 moles of alkylene oxide, eg 15–20. Preferably the alkylene oxide is ethylene oxide. The alcohols may be saturated or unsaturated. The alkoxylate may be/include propoxylate groups. Examples include coco 5 EO, coco 20 EO, lauryl 4 EO and lauryl 23 EO.

Suitable alcohol ethoxylates include the condensation products of coconut fatty alcohol with 15–20 moles of ethylene oxide, e.g. coco 20 ethoxylate, and, condensation products of tallow alcohol with 10–20 moles of ethylene oxide, e.g. tallow 15 ethoxylate. Examples of suitable nonionic surfactants include Genapol T-110, Genapol T-150, Genapol T-200, Genapol C-200 all ex Hoechst AG, Lutensol AT18 ex BASF, Genapol 0-100 and Genapol 0-150 ex Hoechst.

When present in the compositions the level of nonionic surfactant is preferably within the range 0.01 to 5% by weight, more preferably from 0.2 to 3% by weight, most preferably from 0.5 to 2% by weight, e.g. 0.55 to 1% by weight.

The fabric softening compositions may also, optionally include one or more fatty alcohols.

Suitable fatty alcohols which can be used include fatty alcohols of about 10–40 carbon atoms. More preferably the fatty alcohol may have a straight or branched chain alkyl or alkenyl group having from about 10–24, preferably from about 10–20, especially preferably from about 12–20 carbon atoms. Specific examples of the fatty alcohol include decanol, dodecanol, tetradecanol, pentadecanol, hexadecanol, octadecanol, and mixtures thereof.

Furthermore, the fatty alcohol may be of a natural or synthetic origin and may include, for example, mixed alcohol, such as $C_{16}$ to $C_{18}$ alcohols prepared by Ziegler polymerisation of ethylene or by reduction of fatty acids.

Preferably, the fatty alcohol, when present, is present within the range of 0.1 to 0.5% by weight, most preferably 0.2 to 3%, e.g. 0.5 to 1% by weight of the total fabric softening composition.

The amounts of nonionic surfactant and fatty alcohols are expressed as % by weight based upon the total weight of the fabric softening composition including the amount of silicone emulsion product added.

The compositions may also contain one or more optional ingredients, selected from electrolytes, non-aqueous solvents, pH buffering agents, perfume carriers, fluorescers, colorants, hydrotropes, antifoaming agents, antiredeposition agents, polymeric and other thickeners, enzymes, optical brightening agents, opacifiers, anti-shrinking agents, auxiliary anti-wrinkle agents, anti-spotting agents, germicides, fungicides, anti-oxidants, anti-corrosion agents, drape imparting agents, antistatic agents, sunscreens, colour care agents and auxiliary ironing aids.

The product form is a liquid or gel, more especially an aqueous liquid. In liquid products, a viscosity control agent may be included if required. However, in the process of the invention, and the compositions of the invention, such viscosity control agents are not always required. Any viscosity control agent typically used with rinse conditioners is suitable, for example biological polymers such as Xanthum gum (Kelco ex Kelsan and Rhodopol ex Rhone-Poulenc). Synthetic polymers may also be used as viscosity control agents e.g. polyacrylic acid, poly vinyl pyrolidone, polyethylene, carbomers, polyethylene, polyethylene glycols and cellulose-based thickeners such as hydroxy-ethyl cellulose modified to include long chain substituent groups. Also suitable as viscosity modifiers are decoupling polymers and deflocculating polymers.

It is preferred that the compositions are substantially free of bleaches.

The cationic emulsifiers are also believed to enhance deposition of the silicone during use of the fabric softening composition.

Product Form

It is preferred if the final product itself is an aqueous emulsion, preferably a macro-emulsion and not a microemulsion, containing suspended fabric softener and emulsified silicone droplets.

EXAMPLES

Preparation of the Silicone Emulsion

An hydroxy-terminated polydimethylsiloxane (PDMS) having a viscosity of 60,000 cSt was formulated as an aqueous macro-emulsion having the composition:

| Component | % wt |
|---|---|
| PDMS | 60.0 |
| CTAC (1) | 3.5 |

-continued

| Component | % wt |
|---|---|
| COCOPEMAMS (2) | 1.9 |
| Water, acetic acid, and antifoam | to 100 |

(1) cetyl trimethylammonium chloride
(2) coconut pentaethoxymethylammonium methosulphate (1) cetyl trimethylammonium chloride (2) coconut pentaethoxymethylammonium methosulphate The particle size of the emulsified silicone in the emulsion was approximately 0.5 microns.

Example 1

The emulsion, prepared as above, was incorporated into the fabric softener composition of Example 1. The composition of example 1 is given below in which amounts are in % by weight of the total composition:

Example 1; Compositions

| Fabric Softening | Component | | | | | |
|---|---|---|---|---|---|---|
| Composition | Control | A | B | C | D | E |
| Cationic Softener (3) | 13.5 | 13.5 | 13.5 | 13.5 | 13.5 | 13.5 |
| Coconut 20 EO Non-ionic | 0.75 | 0.75 | 0.75 | 0.75 | 0.75 | 0.75 |
| Tallow Alcohol | 0.75 | 0.75 | 0.75 | 0.75 | 0.75 | 0.75 |
| Silicone Anti-foam (5) | 0.03 | 0.03 | 0.03 | 0.03 | 0.03 | 0.03 |
| Proxel GXL (4) | 0.16 | 0.16 | 0.16 | 0.16 | 0.16 | 0.16 |
| Pearlescer (mica) | 0.18 | 0.18 | 0.18 | 0.18 | 0.18 | 0.18 |
| Dye (6) | ← 0.0015 → | | | | | |
| Perfume | 0.95 | 0.95 | 0.95 | 0.95 | 0.95 | 0.95 |
| Emulsion (7) | 0 | 1.66 | 3.33 | 5.00 | 6.66 | 8.33 |
| Silicone PDMS | 0 | 1 | 2 | 3 | 4 | 5 |
| CTAC | 0 | 0.058 | 0.116 | 0.175 | 0.23 | 0.29 |
| COCO-PEMAMS | 0 | 0.031 | 0.063 | 0.095 | 0.126 | 0.158 |
| Water | ← to 100 → | | | | | |

(3) Mixture of 1,2 bis[hardened tallowyloxy]-3-trimethyl ammonium propane chloride and free fatty acid in a weight ratio of 6:1.

(4) Preservative (5) 30% active (6) 1% active (7) The emulsion is the emulsion product which contains the emulsified silicone.

Compositions A, B and C are comparative examples.

The bracketed amounts in the examples are the amounts of the silicone emulsion product added (containing the emulsified silicone). The amounts of silicone etc added by this addition are listed.

The compositions of example 1 were prepared by forming a pre-mix by melting the cationic softener, the coconut 20EO and the tallow alcohol together at 80° C. The water, Proxel and antifoam were heated in a vessel to 55° C. with recirculation. The melted premix was added to the vessel over 5 minutes with milling. The composition was further milled hot for 12 minutes The composition was recirculated, milled and cooled to 30° C. over 36 minutes. Perfume was added at 50° C. The dye solution was added at 30° C. and the product was further milled for 12 minutes. The silicone emulsion was added to the composition and the composition was mixed with recirculation for 10 minutes.

Example 2

PDMS having a viscosity of 300,000 cSt was formulated as an aqueous macroemulsion having the composition:

| Component | % wt |
|---|---|
| PDMS | 60.0 |
| COCOTMAMS (1) | 3.5 |
| COCOPEMAMS (2) | 1.9 |
| Water, preservative, and antifoam | to 100 |

(1) coco trimethyl ammonium methosulphate
(2) described above (1) coco trimethyl ammonium methosulphate (2) described above The particle size of the emulsified silicone in the emulsion was approximately 0.5 microns.

The emulsion was incorporated into the fabric softening compositions of example 1. The compositions were prepared according to the method described in example 1.

The following compositions were obtained:

| Fabric | Component | | | | |
|---|---|---|---|---|---|
| Softening Composition | F | G | H | I | J |
| Cationic Softener | 13.5 | 13.5 | 13.5 | 13.5 | 13.5 |
| Coconut 20 EO Non-ionic | 0.75 | 0.75 | 0.75 | 0.75 | 0.75 |
| Tallow Alcohol | 0.75 | 0.75 | 0.75 | 0.75 | 0.75 |
| Silicone Anti-foam | 0.03 | 0.03 | 0.03 | 0.03 | 0.03 |
| Proxel GXL | 0.16 | 0.16 | 0.16 | 0.16 | 0.16 |
| Pearlescer (mica) | 0.18 | 0.18 | 0.18 | 0.18 | 0.18 |
| Dye | ← 0.0015 → | | | | |
| Perfume | 0.95 | 0.95 | 0.95 | 0.95 | 0.95 |
| Emulsion (1) | 1.66 | 5.00 | 8.33 | 16.66 | 25.0 |
| Silicone PDMS (2) | 1 | 3 | 5 | 10 | 15 |
| COCOTMAMS | 0.058 | 0.175 | 0.291 | 0.583 | 0.875 |
| COCOPEMAMS | 0.031 | 0.095 | 0.158 | 0.316 | 0.475 |
| Water | ← to 100 → | | | | |

(1) The emulsion product containing the emulsified silicone
(2) viscosity before emulsification was 300,000 cSt

Example 3

The control composition and compositions A to J were stored at 37° C. The viscosity of the examples was measured at various intervals to assess the viscosity stability upon storage. All viscosities were measured at 25° C. on a Haake VT 500 with an MVI bob and cup viscometer. The shear rate was 106 $sec^{-1}$. The viscosity results are given in mpas.

The results for the control example and compositions A to E (where the PDMS had a viscosity of 60,000 cSt before emulsification) are given in Table 1. The results for compositions F to J (comprising PDMS with a viscosity of 300,000 cSt before emulsification) are given in Table 2.

TABLE 1

| | Control 0% silicone | A 1% silicone | B 2% silicone | C 3% silicone | D 4% silicone | E 5% silicone |
|---|---|---|---|---|---|---|
| 0 days | 27 | 30 | 38 | 30 | 35 | 37 |
| 8 days | 29 | 31 | 41 | 41 | 37 | 36 |
| 14 days | 25 | 35 | 50 | 71 | 41 | 34 |
| 27 days | 29 | 396 | 421 | 425 | 46 | 37 |
| 43 days | 530 | >500 | >500 | 520 | 44 | 39 |
| 56 days | | | | | 46 | 34 |
| 70 days | | | | | 483 | >500 |

The above results show that the examples containing 4% and 5% by weight of the silicone of example 1 showed improved viscosity stability upon storage at 37 ° C. over the control and examples containing 1,2 and 3% of the silicone of example A. The concentrated fabric softener compositions should desirably have a viscosity not significantly outside the approximate range $25-_{70}$ mPas after storage.

TABLE 2

| | F 1% silicone | G 3% silicone | H 5% silicone | I 10% silicone | J 15% silicone |
|---|---|---|---|---|---|
| 0 days | 31 | 33 | 33 | 57 | 73 |
| 7 days | 30 | 307 | 45 | 70 | 98 |
| 14 days | 40 | | 49 | 73 | 86 |
| 29 days | 356 | | 41 | 61 | 79 |
| 58 days | | | 40 | 69 | 74 |
| 70 days | | | 37 | 56 | 73 |
| 92 days | | | 33 | 57 | 82 |

The above results demonstrate that examples containing 5,10 and 15% silicone provide excellent viscosity stability at 37° C. and significantly improved stability over compositions containing 1% and 3% silicone.

Example 4

The following example demonstrates the effect of using a mixed (cationic and nonionic) emulsifier for the silicone.

Preparation

PDMS having a viscosity of 60,000 cSt was formulated as an aqueous macroemulsion having the composition:

| Component | % active by weight |
|---|---|
| PDMS | 60.0 |
| Cationic emulsifier (1) | 3.5 |
| Nonionic emulsifier (2) | 1.9 |
| Water, preservative, and antifoam | to 100 |

(1) Cetyl trimethyl ammonium methosulphate
(2) Laurylalcohol 3EO (available from Croda)

The particle size of the emulsified silicone was approximately 0.5 μm.

A fabric softening composition was then prepared (according to the method of preparation as described in example 1) by incorporating this emulsion into a fabric softening composition. The following compositions were obtained:

| Fabric Softening Composition | Component K | L | M | N | O |
|---|---|---|---|---|---|
| Cationic Softener (1) | 13.5 | 13.5 | 13.5 | 13.5 | 13.5 |
| Coconut 20 EO Non-ionic | 0.75 | 0.75 | 0.75 | 0.75 | 0.75 |
| Tallow Alcohol | 0.75 | 0.75 | 0.75 | 0.75 | 0.75 |
| Silicone Anti-foam (1) | 0.03 | 0.03 | 0.03 | 0.03 | 0.03 |
| Proxel GXL (1) | 0.16 | 0.16 | 0.16 | 0.16 | 0.16 |
| Pearlescer (mica) | 0.18 | 0.18 | 0.18 | 0.18 | 0.18 |
| Dye (1) | | | ← 0.0015 → | | |
| Perfume | 0.95 | 0.95 | 0.95 | 0.95 | 0.95 |
| Emulsion (2) | 1.66 | 5.00 | 8.33 | 16.66 | 25.00 |
| Silicone PDMS (3) | 1 | 3 | 5 | 10 | 15 |
| Cationic emulsifier | 0.058 | 0.175 | 0.291 | 0.583 | 0.875 |
| Nonionic emulsifier | 0.031 | 0.095 | 0.158 | 0.316 | 0.475 |

(1) As described in example 1
(2) The emulsion product containing the emulsified silicone
(3) Viscosity before emulsification was 60,000 Cst The compositions were stored at 37° C. The viscosity measurements were taken at 25° C. on a Haake VT 500 at $106s^{-1}$ using an MVI Bob and Cup viscometer. The viscosity readings are given in mPaS.

The results are given in Table 3 below.

TABLE 3

| | K 1% silicone | L 3% silicone | M 5% silicone | N 10% silicone | O 15% silicone |
|---|---|---|---|---|---|
| 0 days | 29 | 31 | 32 | 51 | 87 |
| 7 days | 31 | 298 | 38 | 66 | 100 |
| 14 days | 340 | | 79 | 61 | 92 |
| 29 days | | | 339 | 54 | 81 |
| 56 days | | | | 56 | 86 |
| 92 days | | | | 47 | 80 |

The results demonstrate that, for compositions comprising silicones emulsified with a mixed cationic/nonionic system, the compositions containing 5%, 10% and 15% silicone showed improved viscosity over compositions comprising 1% and 3% silicone.

What is claimed is:

1. A method of improving the viscosity stability upon storage at temperatures of 25° C. or more but below 40° C. of a fabric softening composition comprising:

(a) 8 to 50% by weight of a cationic fabric softening agent; and (b) 0.25 to 2.5% by weight perfume;

by inclusion of 5.0% to 15% by weight of an emulsified silicone, based upon the total amount of the composition, which has been emulsified with one or more cationic surfactants to form a macro-emulsion, with the viscosity of the silicone before emulsification being from 10,000 cSt to 400,000 cSt.

2. A method according to claim 1, wherein, in the emulsified silicone, the median droplet size is from 0.39 μm to 25 μm.

3. A method according to claim 1, wherein the cationic surfactant has a halogen or methosulphate counter-ion and/or the cation is selected from alkyl tri-methylammoniums and their derivatives, in which, at least two of the methyl groups on the nitrogen atom are replaced by (poly) alkoxylated groups.

4. A method of improving the viscosity stability upon storage at temperatures of 25° C. or more but below 40° C. of a fabric softening composition comprising:

(a) 8 to 50% by weight of a cationic fabric softening agent; and (b) perfume;

by the inclusion of 5.0% to 15% by weight of an emsulfied silicone, based upon the total amount of the composition, wherein the median droplet size of the emulsified silcione is at least 0.2 $\mu$m and no greater than 25 $\mu$m and the silicone is emulsified with an emulsifier comprising one or more cationic surfactants.

5. A method according to claim 4, wherein the viscosity of the silicone before emulsification is from 10,000 cSt to 400,000 cSt.

6. A method according to either claim 4, in which the cationic surfactant(s) has a halogen or methosulphate counter-ion and/or the cation is selected from alkyl trimethylammoniums and their derivatives, in which, at least two of the methyl groups on the nitrogen atom are replaced by (poly) alkoxylated groups.

7. A method according to claim 1, wherein in the emulsified silicone emulsion, the total amount of emulsifying cationic surfactant is from 0.5% to 20% by weight of the total composition, and the weight ratio of silicone to total cationic emulsifying surfactant being from 3:1 to 120:1.

8. A method according to claim 1, wherein the cationic fabric softening agent is selected from non-ester linked quaternary ammonium and ester-linked quaternary ammonium compounds.

9. A method according to claim 8, wherein the cationic fabric softening agent is selected from 1,2 bis[hardened-tallowoyloxy]-3-trimethylammonium propane chloride, di-(tallowyloxyethyl)-dimethyl ammonium chloride, di(hardened-tallowoyloxyethyl)-dimethyl ammonium chloride and di-(tallowyloxyethyl)methyl hydroxyethyl methosulphate, and mixtures thereof.

10. A method according to claim 1, wherein the total amount of cationic fabric softening agent is from 10% to 35% of the total composition.

11. A method according to claim 1, wherein the silicone is a poly-di-$C_{1-6}$ alkysiloxane (preferably polydimethylsifoxane) end-terminated by tri-$C_{1-6}$ alkylsilyl (preferably trimethylsilyl) groups or by hydroxy-di-$C_{1-6}$ alkylsilyl (preferably hydroxy-dimethylsilyl) groups or a mixture of both.

12. A method according to claim 1, wherein the weight ratio of total fabric softening agent to total silicone is from 2.5:1 to 10:1.

13. A method according to claim 1, wherein the emulsified silicone is included in an amount of 3.75 wt %–12 wt % in the composition based on the total weight of the composition.

* * * * *